US005111728A

United States Patent [19]

Blucher et al.

[11] Patent Number: 5,111,728

[45] Date of Patent: May 12, 1992

[54] ELECTROMAGNETIC PICKUP DEVICE FOR ELECTRICAL STRING MUSICAL INSTRUMENTS

[75] Inventors: Steven L. Blucher, New York; Michael T. Altilio, Staten Island, both of N.Y.

[73] Assignee: DiMarzio Musical Instrument Pickups, Inc., Staten Island, N.Y.

[21] Appl. No.: 578,763

[22] Filed: Sep. 6, 1990

[51] Int. Cl.[5] ..... G10H 3/18

[52] U.S. Cl. ..... 84/726; 84/727; 84/728

[58] Field of Search ..... 84/725-728

[56] References Cited

U.S. PATENT DOCUMENTS

| | | | |
|---|---|---|---|
| 2,968,204 | 1/1961 | Fender . | |
| 3,177,283 | 4/1965 | Fender . | |
| 4,151,776 | 5/1979 | Stich | 84/728 |
| 4,442,749 | 4/1984 | DiMarzio . | |
| 4,501,185 | 2/1985 | Blucher . | |
| 4,534,258 | 8/1985 | Anderson | 84/728 |
| 4,581,974 | 4/1986 | Fender | 84/725 |

OTHER PUBLICATIONS

DiMarzio Musical Instrument Pick-Ups, Inc. "Pickup Catalog" (copyright 1989).

*Primary Examiner*—Stanley J. Witkowski

*Attorney, Agent, or Firm*—Brumbaugh, Graves, Donohue & Raymond

[57] ABSTRACT

An electromagnetic pickup device for use in an electrical string musical instrument comprises a first coil portion having an upper surface and carrying a plurality of spaced apart magnetic pole pieces, a second coil portion having an upper surface and carrying a like plurality of spaced apart magnetic pole pieces, each of the strings being operatively associated with a pair of pole pieces, one of the pair on each of the coil portions, each of the strings having a resting position and the central vertical axes of the pair of magnetic pole pieces associated with at least one string lying in a plane which intersects the string. An electrical string musical instrument comprising the electromagnetic pickup device of this invention produces a timbre or tonal quality which is more natural and pleasing to the ear than that produced by an electrical string musical instrument employing a conventional dual coil pickup device.

5 Claims, 2 Drawing Sheets

ELECTROMAGNETIC PICKUP DEVICE FOR ELECTRICAL STRING MUSICAL INSTRUMENTS

BACKGROUND OF THE INVENTION

This invention relates to electrical string musical instruments and the like, and more particularly to electromagnetic pickup devices for use with such electrical string musical instruments.

Electromagnetic pickup devices are used in conjunction with string musical instruments such as electric guitars to convert the vibrations resulting from the movement or "picking" of the strings into electrical signals, for subsequent transmission to amplification means to produce a desired sound effect. One type of electromagnetic pickup device employed in electrical string musical instruments such as electric guitars is a single-coil pickup, such as disclosed in U.S. Pat. No. 2,968,204 (Fender), in which a single coil portion has a plurality of magnetic pole pieces, with each pole piece operatively associated with a string of the instrument, the pole pieces lying in a plane spaced from the common plane of the strings, with each string disposed in a plane extending through a space between two adjacent ones of the pole pieces, so that a given string in its "at rest" position is located above and between two adjacent pole pieces.

Another arrangement of an electromagnetic pickup device relative to the strings of an electrical musical instrument is disclosed in U.S. Pat. No. 3,177,283 (Fender), in which an electric guitar having a first electromagnetic pickup operatively associated with certain wound strings of the guitar, and a second electromagnetic pickup adjacent to the first pickup, wherein the second pickup is operatively associated with the unwound strings of the guitar.

Yet another type of electromagnetic pickup device employed in electrical string musical instruments such as electric guitars is a dual-coil or "humbucking" type pickup, which generally has first and second coil portions each having a plurality of spaced-apart magnetic pole pieces operatively associated with the strings of the instrument. In a typical "humbucking" pickup, the pole pieces of the coil portions are positioned relative to one another such that a given string of the instrument in its "at rest" position lies directly above a corresponding pair of pole pieces of the first and second coil portions, which are operatively associated with the string.

The signal transmitted by an electromagnetic pickup device employed in conjunction with a string musical instrument is strongly dependent upon the motions of each guitar string in the immediate vicinity of each string's corresponding magnetic pole pieces. As is well known to those skilled in the art, the strength of the magnetic field in the vicinity of a magnetic pole piece diminishes with the square of the distance from the pole piece. Thus, the signal transduction of the pickup for a given string similarly diminishes, i.e. the area of a given vibrating string susceptible to signal transduction is only that area very close to the face or faces of the corresponding pole piece or pieces.

It is also well known to those skilled in the art that the complex transverse motions of a vibrating string of a string musical instrument, which are converted to an electrical signal or "picked up" by an electromagnetic pickup device, may be precisely described as the algebraic sum of the vibrating string's fundamental vibrational wavelength and its many harmonic wavelengths.

The particular tonal quality or timbre of any musical sound produced by the instrument is strictly dependent upon the relative intensities of the corresponding fundamental and harmonic frequencies.

As previously described, in the case of a typical "humbucking" pickup operatively associated with the strings of an electric guitar, the pickup has first and second coil portions each having a plurality of spaced-apart magnetic pole pieces, wherein the pole pieces are positioned relative to one another such that each string in its "at rest" position lies directly above its corresponding pole pieces of the first and second coil portions. In a perfect guitar string of infinite length, vibrating only at its fundamental frequency, the excursion of the guitar string across the face of each of the two pole pieces per string would be precisely simultaneous and exactly perpendicular to the long axis of the guitar string. The signals picked up from the section of guitar string in the immediate vicinity of each of the two corresponding pole pieces per string would be precisely identical, and by the inversion of electrical and magnetic phase in the two adjacent halves of the pickup, the two signals would mix in phase and perfectly reinforce each other to give an output signal of exactly twice the intensity of either individual signal.

However, in actual practice, each string has a finite length and vibrates at its fundamental plus many harmonic frequencies. During typical playing of the instrument, the freely vibrating length of a guitar string is on the order of only about 12 inches, and the wavelengths of the string's vibrational harmonics are corresponding fractions of this short length. At any given instant in time, it may happen that one harmonic component of a vibrating guitar string has a wavelength of exactly twice the spatial separation of the two pole pieces per string. With the typical guitar string and typical "humbucking" pickup previously described, this would occur around the seventh and eighth harmonics of the fundamental frequency. When this occurs, the guitar string excursion representing these harmonic components of string vibration in the immediate vicinity of each pole piece per string would be of approximately equal length but in opposite directions. By the inversion of electrical and magnetic phase in the two adjacent halves of the pickup, the signals of these wavelengths are effectively cancelled. Other harmonics are similarly cancelled to a lesser extent, and still other harmonics are reinforced by the same means. This alteration of the final mix of fundamental frequency plus harmonics results in a particular timbre or tonal quality that may be perceived by the listener as unnatural.

It is well-known among persons skilled in the art of guitar playing that the tonal quality of a typical "humbucking" pickup as previously described is distinctly different from that of a single-coil pickup (in which only one magnetic pole piece is associated with each string) and that the single-coil timbre is superior and more pleasing in many styles of playing. It is theorized that the reasons for the inferiority of timbre in the typical "humbucking" guitar pickup is the unnatural reinforcement and cancellation of certain harmonic frequencies by the mechanism already described. However, in certain types of music playing, such as so-called "hard rock" music, a "humbucking" pickup is preferred by those skilled in the art. In view of the foregoing, it would clearly be advantageous to have a dual coil or "humbucking" pickup device which is less susceptible to the unnatural reinforcement and cancellation of certain harmonic frequencies, as previously described.

The electromagnetic pickup device of this invention provides such a dual coil pickup without the above-described attendant problems. It is one object of this invention to provide an electromagnetic dual coil pickup device for use in an electrical string instrument, comprising a first coil portion having an upper surface and carrying a plurality of spaced apart magnetic pole pieces, a second coil portion having an upper surface and carrying a like plurality of spaced apart magnetic pole pieces, each of the strings being operatively associated with a pair of pole pieces, one of the pair on each of the coil portions, each of the strings having a resting position and the central vertical axes of the pair of magnetic pole pieces associated with at least one string lying in a plane which intersects the string. It is a feature of this invention that when the above-described pickup device is operatively associated with the strings of an electrical string musical instrument, a higher quality and enhanced sound effect with a more natural and more pleasing timbre or tonal quality is advantageously produced from the instrument.

It is another object of this invention to provide an electrical string musical instrument comprising the above-described electromagnetic pickup device of this invention. It is a feature of the electrical musical instrument of this invention that all of the strings of the instrument are operatively associated with the pickup device in such a manner that, when caused to vibrate or "picked", the vibrating strings advantageously produce a higher quality sound effect with a more natural and more pleasing timbre or tonal quality than that typically produced by an electrical string musical instrument employing a conventional dual coil pickup device.

SUMMARY OF THE INVENTION

This invention is directed to an electromagnetic pickup device for use in an electrical string instrument, comprising a first coil portion having an upper surface and carrying a plurality of spaced apart magnetic pole pieces, a second coil portion having an upper surface and carrying a like plurality of spaced apart magnetic pole pieces, each of the strings being operatively associated with a pair of pole pieces, one of the pair on each of the coil portions, each of the strings having a resting position and the central vertical axes of the pair of magnetic pole pieces associated with at least one string lying in a plane which intersects the string.

In another preferred embodiment of this invention, the first coil portion and the second coil portion are vertically offset with respect to one another. In another preferred embodiment, the first coil portion and the second coil portion are vertically aligned with respect to one another. In another preferred embodiment, the magnetic pole pieces of the first and second coil portions are spaced an equal distance apart. In yet another preferred embodiment, the magnetic pole pieces of the first coil portion are equally spaced a first distance apart, and the magnetic pole pieces of the second coil portion are equally spaced a second difference apart, with the second distance being less than the first distance.

This invention is also directed to an electrical string musical instrument comprising the above-described electromagnetic pickup device, wherein the instrument comprises a body and a plurality of strings mounted over the body in tensioned relationship. The above-described pickup device is operatively associated with all of the strings of the instrument to convert into electrical signals the vibrations resulting from movement or "picking" of the strings. This invention is advantageous over conventional dual coil or "humbucking" electromagnetic pickup devices which are operatively associated with electrical string instruments in that this invention produces an enhanced and higher quality sound effect with a more natural and more pleasing timbre or tonal quality than the sound effect produced from an electrical string instrument employing a conventional "humbucking" electromagnetic pickup device.

DESCRIPTION OF THE PREFERRED EMBODIMENTS

Figure 1:
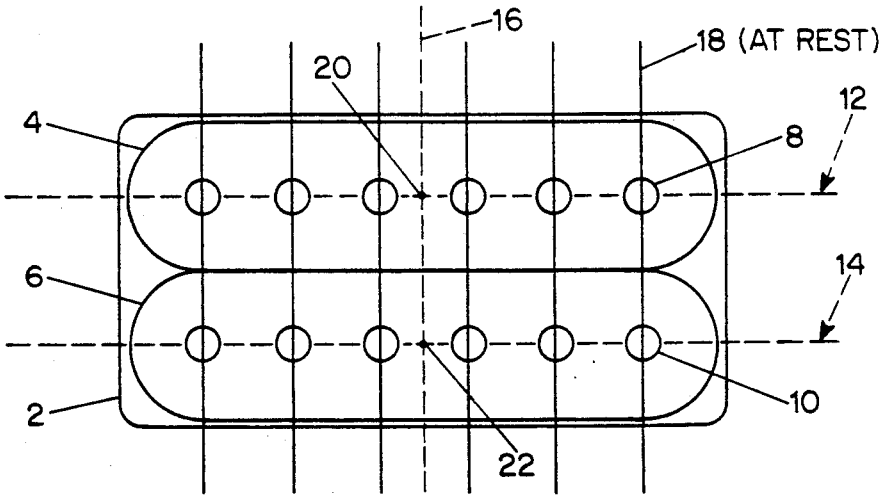
FIG. 1 (PRIOR ART)
FIG. 1 is a plan view of a standard "humbucking" electromagnetic pickup device employed in electric guitars.

This invention will become apparent from the following detailed description.

The pickup device of this invention comprises a first coil portion having an upper surface and carrying a plurality of spaced apart magnetic pole pieces, a second coil portion having an upper surface and carrying a like plurality of spaced apart magnetic pole pieces, each of the strings being operatively associated with a pair of pole pieces, with one of the pair of pole pieces on each of the coil portions, each of the strings having a resting position, and the central vertical axes of the pair of magnetic pole pieces associated with at least one string lying in a plane which intersects the string.

In on preferred embodiment of this invention, the first coil portion and the second coil portion are vertically offset with respect to one another. In another preferred embodiment, the first coil portion and the second coil portion are vertically aligned with respect to one another. In another embodiment, the magnetic pole pieces of the first and second coil portions are spaced an equal distance apart. In yet another preferred embodiment he magnetic pole pieces of the first coil portion are equally spaced a first distance apart, and the magnetic pole pieces of the second coil portion are equally spaced a second difference apart, with the second distance being less than the first distance.

The magnetic pole pieces employed in the pickup device of this invention are made of metallic and magnetizable material, and may be counted in a base late to which the first and second coil portions are mounted in accordance with, for example, co-assigned U.S. Pat. No. 4,501,185 (Blucher), incorporated herein by reference. The electrical signal produced in accordance with this invention is processed by means well known to those skilled in the art, for example as employed in U.S.

Pat. Nos. 2,968,204 and 3,177,283, discussed hereinabove and incorporated herein by reference, and the signal is thereafter transmitted to conventional amplification means such as amplifiers and the like which are operatively associated with the electrical string instrument by conventional electrical circuitry means to produce a higher quality and enhanced sound effect.

Without wishing to be bound by any one theory, it is believed that the arrangement of the coil portions and their respective magnetic pole pieces according to the present invention provide a magnetic field wherein the field is defined in terms of the corresponding pole pieces associated with a given string, i.e. a first corresponding pole piece of the first coil portion has a certain polarity (e.g. a "North" polarity) and the second corresponding pole piece of the second coil portion has an opposite polarity (e.g. a "South" polarity). Thus, a magnetic field is produced by the corresponding pair of pole pieces, and the corresponding string associated with these pole pieces vibrates through the field when the string is set into motion. Due to the spatial arrangement of a given corresponding set of pole pieces relative to the "at rest" position of the corresponding string, it is impossible for the aforementioned harmonic components of vibration of the guitar string to have exactly equal but opposite motions within the small areas of signal transduction associated with each of the two pole pieces per string, and therefore it is impossible for the signal resulting from these harmonic vibrations to be exactly cancelled. It is similarly impossible for other harmonic string motions to have equal magnitudes and the same direction. Therefore, these arrangements effectively prevent the total cancellation of certain harmonics and the double reinforcement of other harmonics. Although some partial reinforcement and cancellation does occur, the effect is distinctly less than in the typical "humbucking" pickup. This results in a timbre or tonal quality that is more natural and more pleasing.

Referring now to the drawings, FIG. 1 depicts a plan view of a conventional dual coil or "humbucking" electromagnetic pickup device well known to those skilled in the art, which is typically operatively associated with the strings of an electrical string musical instrument such as an electrical guitar. In FIG. 1, the electromagnetic pickup device comprises base plate 2, having affixed thereto a first or upper coil portion 4 and a second or lower coil portion 6 which are adjacent to one another. Each coil portion 4 and 6 respectively comprises a plurality of equally-spaced apart magnetic pole pieces 8 and 10, which are mounted in such a manner on coil portions 4 and 6, respectively, that each of the magnetic pole pieces 8 and 10 of each coil portion 4 and 6 lies along respective horizontal center lines 12 and 14 respectively, as shown. First coil portion 4 and second coil portion 6 are positioned such that the centers 20 and 22 of coil portions 4 and 6, respectively, both lie on vertical center line 16, as shown. Each of pole pieces 8 and 10 is positioned directly beneath the "at rest" position of an associated string from the plurality of strings 18 of the instrument (not shown). For example, in FIG. 1, magnetic pole pieces 8 and 10 are operatively associated with string 18, and magnetic pole pieces 8 and 10 lie directly beneath string 18 when it is in its "at rest" position. The electromagnetic pickup depicted in FIG. 1 is operatively associated with the plurality of instrument strings 18 in such a manner that as the strings are caused to vibrate or "picked" each vibrating string passes through a magnetic field produced by the magnetic pole pieces 8 and 10, thereby generating a voltage which is converted to an electrical signal by conversion means (not shown), the signal in turn being transmitted by electrical circuit means (not shown) to amplification means (not shown) in order to produce the desired sound effect from the instrument.

Figure 2:
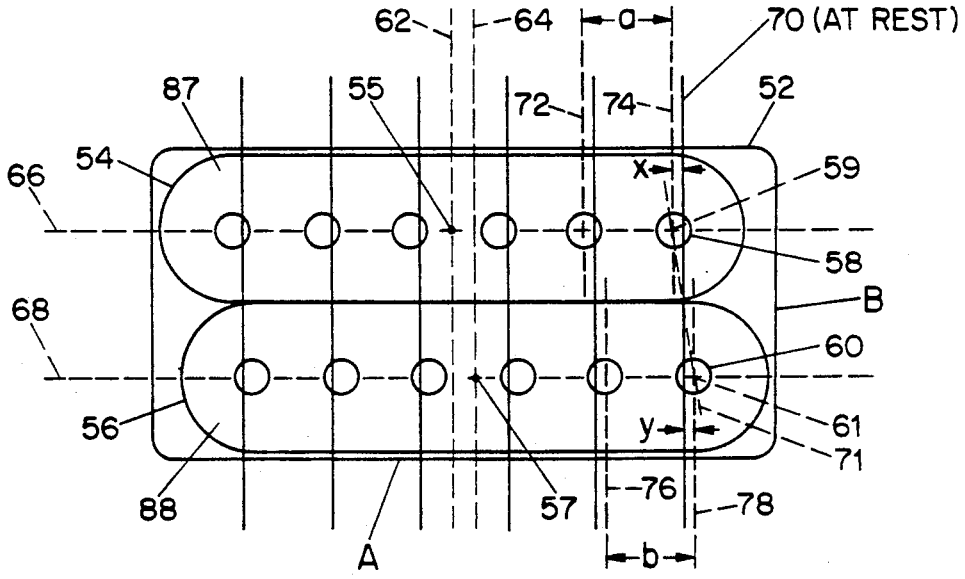
FIG. 2 is a plan view of one embodiment of the electromagnetic pickup device of this invention.

With respect to FIG. 2, the present invention and specifically one particularly preferred embodiment of this invention shall be described. In FIG. 2, the electromagnetic pickup device comprises a base plate 52 having affixed thereto a first coil portion 54 and a second coil portion 56 adjacent to one another, with each coil portion having a plurality of equally-spaced magnetic pole pieces 58 and 60, respectively, which are operatively associated with all of the respective strings 70 of the instrument (not shown). The plurality of strings 70 in FIG. 2 are shown at rest. In this embodiment, coil portions 54 and 56 are vertically offset with respect to one another. As used in this description and the appended claims, "vertically offset" refers to the positioning of the first and second coil portions wherein the vertical center lines passing through the center point located on the upper surface of each coil portion are parallel. For example, in FIG. 2 the vertical center lines 62 and 64, which pass through centers 55 and 57, respectively, of the first and second coil portions 54 and 56 are parallel with respect to one another, thus coil portions 54 and 56 are vertically offset with respect to one another. In addition, each of pole pieces 58 and 60 lies along respective central horizontal lines 66 and 68 of first and second coil portions, 54 and 56, respectively. Central vertical axes 59 and 61 of magnetic pole pieces 58 and 60, respectively, extend outward from the plane in which lie upper surfaces 87 and 88 of coil portions 54 and 56, respectively. As a result, central vertical axes 59 and 61 of the pair of each of magnetic pole pieces 58 and 60 lie in a plane (illustrated by dashed line 71) which intersects string 70. In this embodiment, the spacing of magnetic pole pieces 58 of coil portion 54 and the spacing of magnetic pole pieces 60 of coil portion 56 are equal. Thus, for example, distance "a" depicted between vertical center lines 72 and 74 of pole pieces 58 of coil portion 54 is equal in length to distance "b" depicted between vertical center lines 76 and 78 of pole pieces 60 of coil portion 56.

Thus, as shown, when the strings 70 of an electric musical instrument (not shown) comprising the electromagnetic pickup device of FIG. 2 are set in motion or "picked", each of strings 70 vibrates through a magnetic field having a breadth defined by the respective magnetic pole pieces 58 and 60 operatively associated with each of strings 70, thereby generating a voltage from the vibration of the strings 70 through the magnetic field. This voltage is converted into an electrical signal by conventional means for converting voltages obtained from electromagnetic pickup devices (not shown), and the electrical signal is conveyed to amplification means (not shown) such as amplifiers and the like in order to produce the desired sound effect.

In FIG. 2, the positioning of pole pieces 58 and 60, as previously described, is such that the central vertical axes 59 and 61 of the pair of pole pieces 58 and 60 associated with each string 70 lie in a plane which intersects string 70. Moreover, in a particularly preferred embodiment, the "at rest" position of string 70 is equidistant from the centers of each of the corresponding pair of pole pieces (i.e. distances x and y, between the "at rest" position of string 70 and vertical center lines 74 and 78 of pole pieces 58 and 60, respectively, are equal). Thus, when caused to vibrate or "picked", string 70 vibrates an equal distance or is displaced an equal distance from its "at rest" vertical position within the magnetic field produced by the corresponding respective magnetic pole pieces. This in turn produces an enhanced sound effect with reduced degradation of sound quality.

Figure 3A:
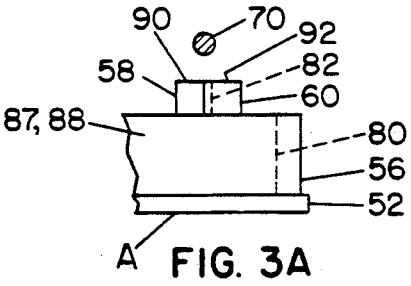
FIG. 3A is a side view of a portion of one end of the embodiment of this invention depicted in FIG. 2.

FIG. 3A depicts a side view of a portion of face A of the pickup device of FIG. 2. In FIG. 3A, base plate 52 has affixed to it first coil portion 54 and second coil portion 56. As first coil portion 54 is located behind second coil portion 56, first coil portion 54 is represented by hidden edge 80, which represents the exterior edge of first coil portion 54. Magnetic pole pieces 58 and 60 are slidably mounted in coil portions 54 and 56, respectively, and thus may be varied in position in a direction transverse to the upper surfaces 87 and 88 of first and second coil portions 54 and 56, respectively. In the embodiment depicted in FIG. 3A, magnetic pole pieces 58 and 60 fully extend an equal distance from the upper surfaces 87 and 88 of coil portions 54 and 56, respectively, with the upper faces 90 and 92 of pole pieces 58 and 60 thus lying in a plane parallel to and above the upper surfaces 87 and 88 of coil portions 54 and 56, this plane also being parallel to and below the plane in which string 70 (operatively associated with pole pieces 58 and 60) lies in its "at rest" position. In FIG. 3A, magnetic pole piece 58 is partially obscured from view by magnetic pole piece 56, hence the hidden edge of pole piece 58 is depicted by hidden edge 82.

Figure 3B:
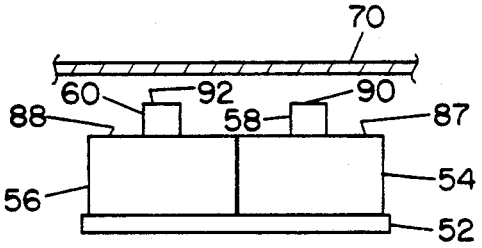
FIG. 3B is a side view of another end of the embodiment of this invention depicted in FIG. 2.

FIG. 3B depicts a side view of face B of the pickup device of FIG. 2. In FIG. 3B, base plate 52 has affixed to it first coil portion 54 and second coil portion 56. As previously described with respect to FIG. 3A, magnetic pole pieces 58 and 60 are fully extended from upper surfaces 87 and 88 of coil portions 54 and 56, respectively, with the upper faces 90 and 92 of magnetic pole pieces 58 and 60 lying in a plane parallel to and above the upper surfaces 87 and 88 of coil portions 54 and 56, this plane also being parallel to and below the plane in which string 70 (operatively associated with pole pieces 58 and 60) lies in its "at rest" position.

Figure 3C:
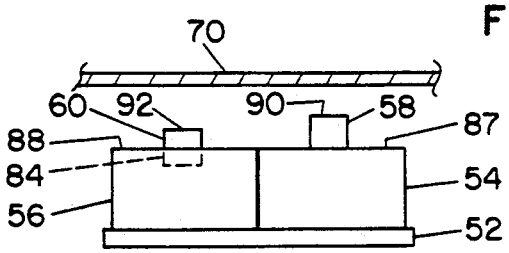
FIG. 3C is another view of the end of the embodiment of this invention depicted in FIG. 3B.

FIG. 3C depicts another side view of face B of the pickup device of FIG. 2. In FIG. 3C, base plate 52 has affixed to it first coil portion 54 and second coil portion 56. As in FIGS. 3A and 3B, magnetic pole pieces 58 and 60 are slidably mounted in coil portions 54 and 56, respectively, and thus may be varied in position in a direction transverse to the upper surfaces 87 and 88 of first and second coil portions 54 and 56, respectively. However, in FIG. 3C magnetic pole piece 58 is fully extended from upper surface 87 of first coil portion 54, whereas magnetic pole piece 60 is only partially extended from upper surface 88 of coil portion 56, with the remainder of pole piece 60 shown by hidden edge 84 as residing in the interior of coil portion 56. Thus, upper faces 90 and 92 of pole pieces 54 and 56, respectively, lie in parallel planes above and parallel to the upper surfaces 87 and 88 of coil portions 54 and 56. These planes are also parallel to and below the plane in which string 70 (operatively associated with pole pieces 58 and 60) lies in its "at rest" position.

As is well known to those skilled in the art, the position of an individual pole piece (as, for example, depicted in FIGS. 3B and 3C) is chosen by the person playing the electrical string instrument of this invention so as to achieve a certain sound quality or timbre for a given string of the instrument, as determined by the ear of the person playing the instrument. Thus, each pole piece of the pickup device of this invention may have its position varied transversely to the upper surface of its respective coil portion and thereby allow the upper surface of the pole piece to lie in any one of a plurality of planes parallel to and above the upper surface of the coil portion in which it is carried as well as parallel to and below the plane in which a given string of the instrument lies in its "at rest" position, the pole piece being operatively associated with the string.

Figure 4:
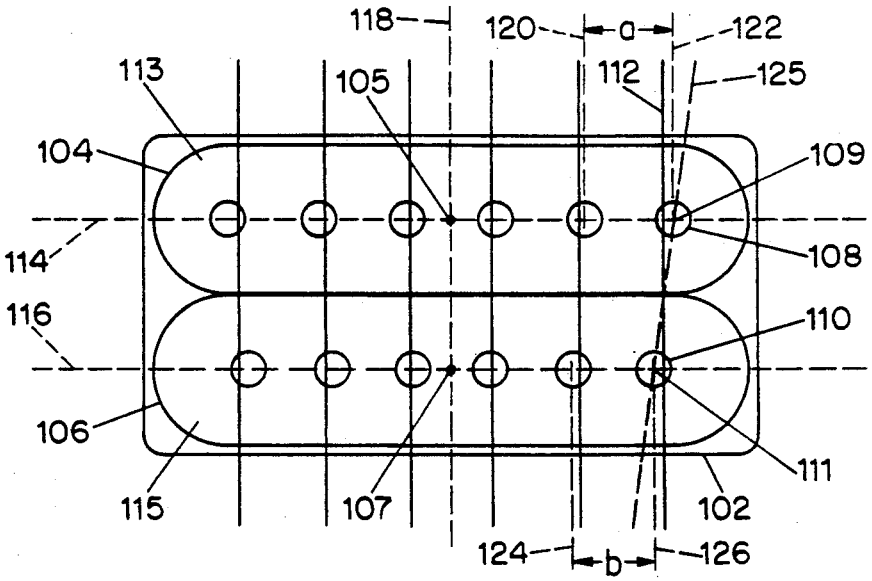
FIG. 4 is a plan view of another embodiment of the electromagnetic pickup device of this invention.

FIG. 4 depicts another particularly preferred embodiment of the electromagnetic pickup device of this invention. In FIG. 4, base plate 102 has affixed to it a first coil portion 104 and a second coil portion 106, each having a plurality of spaced apart magnetic pole pieces 108 and 110, respectively. Each of the magnetic pole pieces of each coil portion 104 and 106 are operatively associated with a respective string 112 of the instrument (not shown). The strings 112 are shown in an "at rest" position. In this embodiment, the coil portions 104 and 106 are vertically aligned with respect to one another. As used in this description and in the appended claims, "vertically aligned" refers to the positioning of the first and second coil portions wherein the vertical center lines passing through the center point located on the upper surface of each coil portion are identical. For example, in FIG. 4 the vertical center lines of the first and second coil portions 104 and 106, which pass through centers 105 and 107, respectively, are identical, as represented by vertical center line 118. Thus, in this embodiment, the coil portions 104 and 106 are vertically aligned with one another. The horizontal center lines, 114 and 116 respectively, of the first and second coil portions 104 and 106, pass through centers 105 and 107, respectively, and are parallel with respect to one another, as shown. Central vertical axes 109 and 111 of each of the plurality of pole pieces 108 and 110, respectively, extend outward from the plane in which lie upper surfaces 113 and 115 of coil portions 104 and 106, respectively. As a result, central vertical axes 109 and 111 of at least one pair of magnetic pole pieces 108 and 110, respectively, lie in a plane (illustrated by dashed line 125) which intersects string 112.

In this embodiment, the spacing of the plurality of magnetic pole pieces 108 and 110 are different for each of coil portions 104 and 106. Thus, for example, a first distance "a" depicted between vertical center lines 120 and 122 of pole pieces 108 is greater in length than second distance "b" depicted between vertical center lines 124 and 126 of pole pieces 110. As previously discussed with respect to the embodiment depicted in FIG. 2, the individual magnetic pole pieces of the embodiment depicted in FIG. 4 are slidably mounted in coil portions 104 and 106 to permit varying the position of each magnetic pole piece in a direction transverse to the upper surface of its respective coil portion.

In FIG. 4, as each of the strings 112 is "picked" and passes through the magnetic field created by the magnetic pole pieces 108 and 110 of the respective coil portions 104 and 106, a voltage is generated. This voltage is then converted to an electrical signal by conventional conversion means (not shown) and transmitted to amplification means (not shown) such as amplifiers and the like to provide the desired sound effect.

Figure 5:
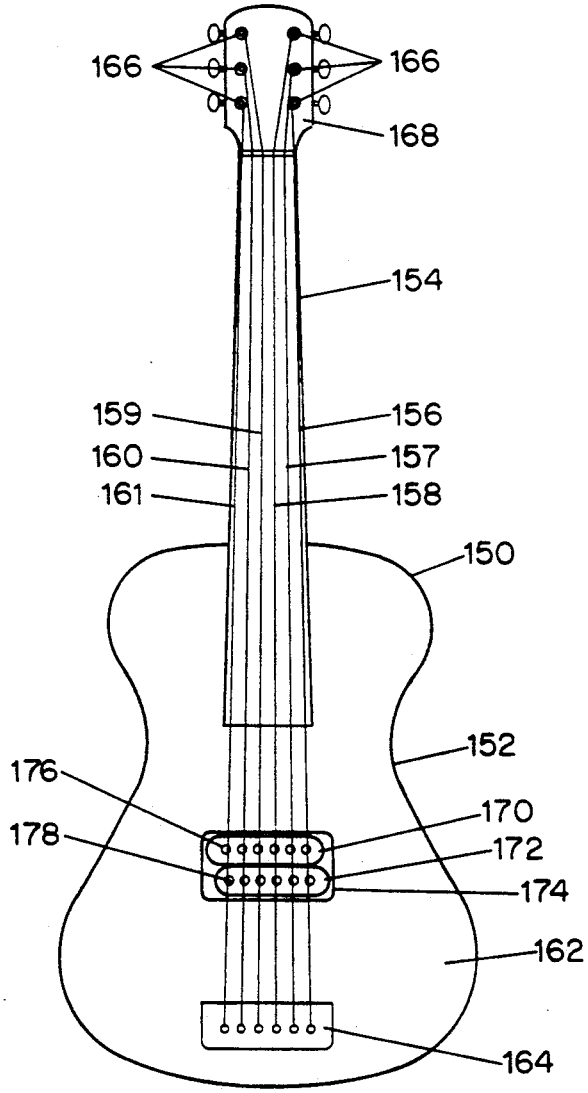
FIG. 5 is a plan view of an electric guitar instrument of this invention comprising the electromagnetic pickup device of this invention.

FIG. 5 depicts a basic configuration of an electrical string musical instrument, i.e. an electrical guitar, which is another embodiment of this invention. In FIG. 5, the electric guitar is indicated generally at 150, having a body 152 to which is connected a neck 154. Mounted in tensioned relationship over the body 152 and neck 154 are a plurality of strings 156–161 as shown, which are substantially parallel to each other and lie generally in a plane which is parallel to the face of the body 152, such face being indicated at 162. The strings are stretched between a bridge assembly 164 which is mounted on the face 162 of body 152, and suitable turning screws 166 provided on the head 168 at the outer end of neck 154. The guitar strings 156–161 may be wound or unwound suitable magnetizable material such as steel, or a combination thereof. An electromagnetic pickup device of this invention, as previously described, and, for example, depicted in FIG. 2, having a first or upper coil portion 170 and second or lower coil portion 172, which are vertically offset, are both affixed to a base plate 174 as previously described, which is in turn affixed to guitar face 162, with the magnetic pole pieces 176 of first coil portion 170 and magnetic pole pieces 178 of second coil portion 172 of the pickup device each being operatively associated with all of strings 156–161. As the individual strings 156–161 are caused to vibrate or are "picked", these strings 156–161 vibrate through the magnetic field established by the magnetic pole pieces of first coil portion 170 and second form portion 172, as previously discussed. The voltage produced by the vibration of the strings 156–161 through this magnetic field is converted to an electrical signal by conventional conversion means (not shown) and transmitted by electrical circuitry means (not shown) to amplification means (not shown) such as amplifiers or other suitable sound amplification equipment to produce the desired sound effect. Other embodiments of the pickup device of this invention, such as the embodiment set forth in FIG. 4, may alternatively be employed in the electrical string instrument of this invention.

As previously discussed, while not wishing to be bound by any one theory, it is theorized that the positioning of the magnetic pole pieces located on upper coil portion 170 and lower coil portion 172 of the electromagnetic pickup device in accordance with this invention allow the vibrating strings 156–161 to pass over a magnetic field where due to the spatial arrangement of a given corresponding set of pole pieces relative to the "at rest" position of the corresponding string, it is impossible for the aforementioned harmonic components of vibration of the guitar string to have exactly equal but opposite motions within the small areas of signal transduction associated with each of the two pole pieces per string, and therefore it is impossible for the signal resulting from these harmonic vibrations to be exactly cancelled. It is similarly impossible for other harmonic string motions to have equal magnitudes and the same direction. Therefore, these arrangements effectively prevent the total cancellation of certain harmonics and the double reinforcement of other harmonics. As a result, the timbre or tonal quality produced by each of vibrating strings 156–161, is more natural and pleasing to the ear than that obtained from an instrument employing a conventional "humbucking" pickup.

Although this invention has been illustrated by reference to specific embodiments, it will be apparent to those skilled in the art that various changes and modifications may be made which clearly fall within the scope of this invention.

I claim:

1. An electromagnetic pickup device for an electrical musical instrument having a plurality of strings comprising a first laterally extending coil potion having an upper surface;

a first plurality of spaced apart elongated magnetic pole pieces equal in number to said strings carried by said first coil portion, each said pole piece having one end extending through the upper surface of said first coil portion and said pole pieces being disposed in substantially parallel relationship to each other, all of said pole pieces having said one ends magnetized with the same given polarity;

a second laterally extending coil potion having an upper surface;

a second plurality of spaced part elongated magnetic pole pieces equal in number to said strings carried by said second coil portion, each said pole piece having one end extending thought the upper surface of said scan coil portion and said pole pieces being disposed in parallel relationship to each other, all of said second plurality of pole pieces having said one ends magnetized with the same polarity and opposite to said given polarity of said one ends of said first polarity of pole pieces;

said first and second coil portions being disposed alongside one another with their upper surfaces substantially int he same plane and with said first and second pluralities of magnetic pole pieces extending from said respective upper surfaces towards said strings, whereby with said pickup device installed on the instrument, each string is operatively associated with a separate pair of pole pieces, one of said pair carried by each oil portion, the pole pieces of each such pair presenting opposite polarities to its respective string;

each of said strings having a resting position and the central vertical axes of the pair of magnetic pole pieces associated with at least one string lying on opposite sides of said string and an a plane which intersects the string when said string is in its resting position.

2. A pickup device according to claim 1, in which said first an second coil portions are laterally offset with respect to one another and the magnetic pole pieces carried by each of said coil portions are spaced the same equal distance apart.

3. A pickup device according to claim 1, in which said first and second coil portions are laterally aligned with each other, the magnetic pole pieces carried by said first coil portion are spaced a first equal distance apart and the magnetic pole pieces carried by said second coil position are spaced a second equal distance apart, said second equal distance being different from said first equal distance.

4. A pickup device according of claim 1 in which the central vertical axes of each of said separate pairs of magnetic pole pieces lie in a plane which intersects its respective string.

5. An electrical string musical instrument comprising a body, a plurality of strings mounted over the body in tensioned relationship with each string having a resting position, and an electromagnetic pickup device as set forth in claim 1 to convert into electrical signals the vibrations resulting from picking of the strings.

* * * * *

UNITED STATES PATENT AND TRADEMARK OFFICE

CERTIFICATE OF CORRECTION

PATENT NO. : 5,111,728

DATED : May 12, 1992

INVENTOR(S) : Steven L. Blucher

It is certified that error appears in the above-identified patent and that said Letters Patent is hereby corrected as shown below:

Col. 4, line 55, "he" should read -- the --;

Col. 4, line 62, "counted in a base late" should read -- mounted in a base plate;

Col. 9, line 10, "unwound" should read -- unwound wires formed of a --;

Col. 10, lines 4 and 14, "potion" should read -- portion --;

Col. 10, line 19, "thought" should read --through--;

Col. 10, line 20, "scan" should read --second--;

Col. 10, line 28, "int he" should read --in the--;

Col. 10, line 34 "oil" should read -- coil --;

Col. 10, line 44, "an" should read -- and --;

Col. 10, line 56, "of" should read -- to --.

Signed and Sealed this

Seventh Day of September, 1993

Bruce Lehman

*Attest:*

BRUCE LEHMAN

*Attesting Officer*

*Commissioner of Patents and Trademarks*